US006095285A

United States Patent [19]

St-Germain

[11] Patent Number: 6,095,285

[45] Date of Patent: Aug. 1, 2000

[54] SCAFFOLDING

[76] Inventor: André St-Germain, 1340, Rang du Bassin, St-Bonaventure P.Q., Canada, J0C 1C0

[21] Appl. No.: 09/379,369

[22] Filed: Aug. 23, 1999

[51] Int. Cl.[7] ..... E04G 1/20

[52] U.S. Cl. ..... 182/146; 182/141; 182/62.5

[58] Field of Search ..... 182/146, 82, 228, 182/141, 62.5

[56] References Cited

U.S. PATENT DOCUMENTS 4,541,297 9/1985 Fujita .
5,159,993 11/1992 St-Germain ..... 182/146
5,368,125 11/1994 St-Germain .
5,636,705 6/1997 St-Germain .
5,823,291 10/1998 Goldbach ..... 182/141

*Primary Examiner*—Alvin Chin-Shue
*Attorney, Agent, or Firm*—Holland & Knight LLP

[57] ABSTRACT

In a scaffolding at least one tower anchor to secure the tower to a wall, a sleeve surrounding the tower and guided for up and down movement along the same, a support frame releasably secured to the sleeve in vertical position and normal to the wall, a shiftable frame moveably supported by and parallel to the support frame, replace ("the wall supported by the sleeve not ",) by and releasably secured to the shiftable frame at one end a work platform parallel to for horizontal shifting movement transversely of the tower towards and away from the wall and an actuator carried by the support frame and acting on the work platform through the intermediary of the shiftable frame to effect said shifting movement.

12 Claims, 10 Drawing Sheets

SCAFFOLDING

FIELD OF THE INVENTION

The present invention relates to motorized scaffoldings.

BACKGROUND OF THE INVENTION

Various types of motorized scaffoldings in which a working platform is guided along a tower for up and down movement and actuated to effect this movement are known. Examples of such motorized scaffoldings are found in the ST-GERMAIN U.S. Pat. No. 4,809,814 dated March 1989 and in my own previous U.S. Pat. No. 5,636,705 dated June 1997, and U.S. Pat. No. 5,368,125 dated November 1994.

However, when for instance doing brick work on a building such as an apartment building provided with outwardly protruding balconies or the like, the scaffolding must be installed so that the work platform which only moves in up and down movement clears all the balconies. To reach the wall between the balconies, it is necessary to manually install an extension platform on the work platform which extends towards the building wall between the balconies.

Obviously, this extension platform has to be installed and then removed at each balcony to clear the same. This is a time consuming and sometimes dangerous operation due to the height at which this work is performed.

OBJECTS OF THE INVENTION

It is therefore the main object of the present invention to provide a motorized scaffolding in which the above noted inconvenient and disadvantage is overcome.

Another object of the present invention is to provide a motorized scaffolding in which the work platform can be shifted towards and away from the wall along which the scaffolding is installed.

Another object of the present invention is to provide a motorized scaffolding in which simple means are provided to effect the above noted shifting movement of the work platform.

SUMMARY OF THE INVENTION

In a scaffolding comprising a tower, a plurality of vertically distant anchors to spacedly secure said tower to a wall, a sleeve partially surrounding said tower, driven and guided for up and down movement along the same, a work platform extending generally parallel to said wall supported by said sleeve not only for up and down movement along said tower but also for horizontal shifting movement transversely of said tower towards and away from said wall, and an actuator supported by said sleeve and acting on said work platform to effect said shifting movement.

In a scaffolding further including a support frame releasably secured to said sleeve in vertical position and normal to said wall, a shiftable frame moveably supported by and parallel to said support frame, said work platform releasably secured to said shiftable frame at one end, said actuator carried by said support frame and acting on said work platform through the intermediary of said shiftable frame.

In a scaffolding further including first and second similar upwardly directed hooks respectively secured to said sleeve and to said shiftable frame, said support frame releasably supported by said first hooks and said platform releasably supported by said second hooks and capable of being directly releasably supported by said first hooks in the absence of said support frame, said actuator and said shiftable frame.

In a scaffolding further including rollers carried by said support frame and rollably supporting said shifting frame.

In a scaffolding wherein said actuator includes an endless screw rotatably mounted on said support frame with its rotation axis parallel to the shifting direction of said shiftable frame, reversible motors to rotate said screw in opposite directions and equally spaced endless screw engaging members secured to said shiftable frame.

In a scaffolding wherein said actuator includes a double acting hydraulic ram for shifting said shiftable frame between two shifted limit positions.

In a scaffolding further including rollers carried by said support frame and rollably supporting said shiftable frame.

In a scaffolding wherein said actuator includes and endless screw rotatably mounted on said support frame with its rotation axis parallel to the shifting direction of said shiftable frame, reversible motors to rotate said screw in opposite directions and equally spaced endless screw engaging members secured to said shiftable frame.

In a scaffolding wherein said actuator includes a double acting hydraulic ram for shifting said shiftable frame between two shifted limit positions.

In a scaffolding further including an abutment secured to said support frame and stops secured to said shiftable frame and selectively engaging said abutment when said shiftable frame reaches one or the other of its two shifted limit positions.

In a scaffolding wherein said two limit positions are substantially equally distant from an intermediate position wherein said shiftable frame is substantially centered relative to said support frame and to said tower.

In a scaffolding wherein said two limit positions are substantially equally distant from an intermediate position wherein said shiftable frame is substantially centered relative to said support frame and to said tower.

In a scaffolding further including a second tower, an additional plurality of vertically spaced anchors to spacedly secure said second tower to said wall in a spaced position along said wall relative to said first claimed tower, a second sleeve partially surrounding said second tower driven and guided for up and down movement along said second tower, said work platform extending horizontally between said two sleeves and supported by the same at both its ends not only for up and down movement along both towers but also for horizontal shifting movements transversely of both towers towards and away from said wall and an actuator supported by each sleeve and acting on the related end of said work platform to effect said shifting movement.

In a scaffolding further including a support frame releasably secured to each of said sleeves in vertical position and normal to said wall, a shiftable frame supported by and parallel to each support frame and work platform releasably secured at both ends to the respective shiftable frames, said actuators carried by said support frames and acting on the respective ends of said support platform through the intermediary of said shiftable frames.

BRIEF DESCRIPTION OF THE DRAWINGS

In the annexed drawings, like reference characters indicate like elements throughout.

DETAILED DESCRIPTION OF THE PREFERRED EMBODIMENTS

Figure 1:
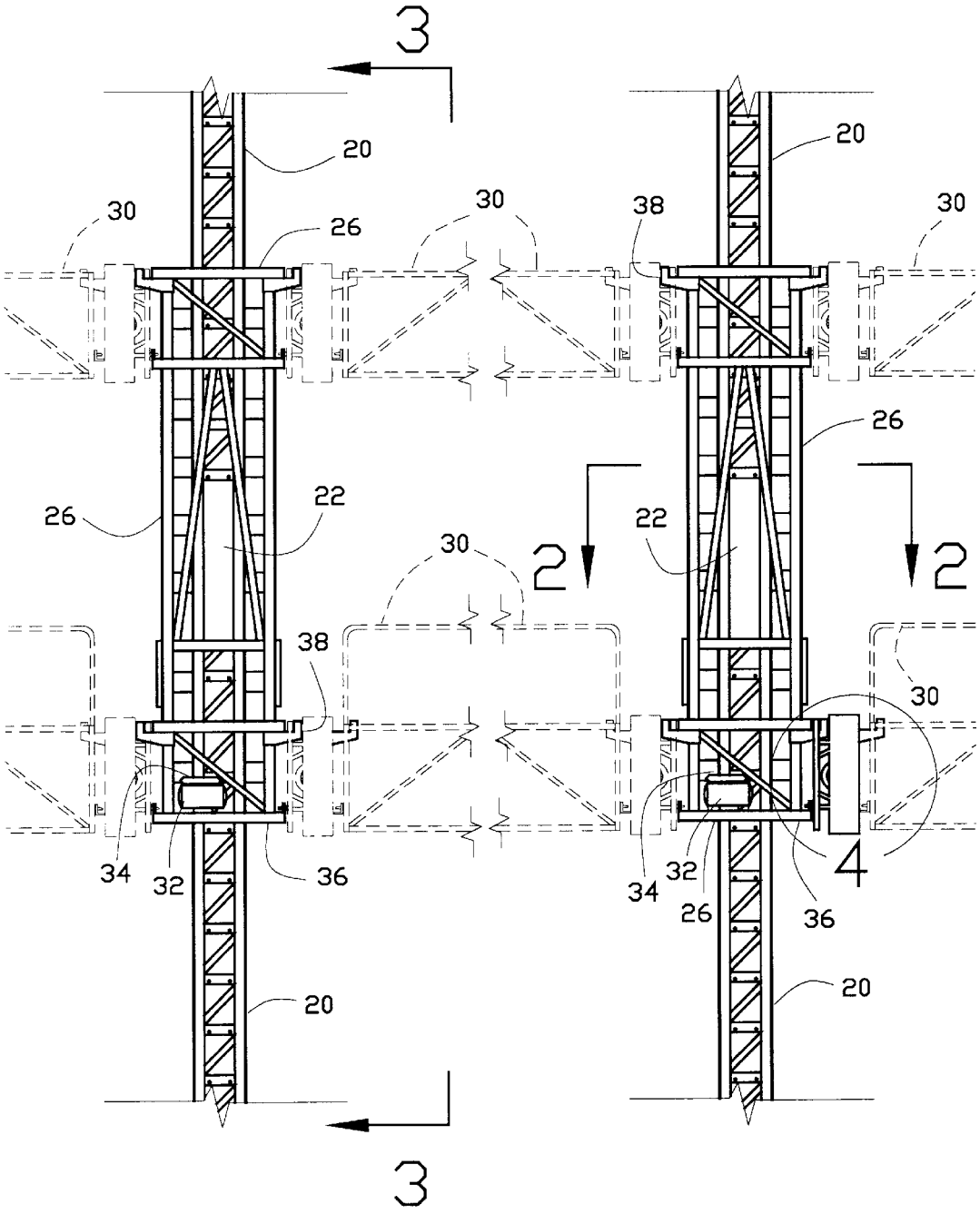
FIG. 1 is a partial elevation of two towers provided with the shifting system of the invention and supporting superposed work platforms.
Figure 2:
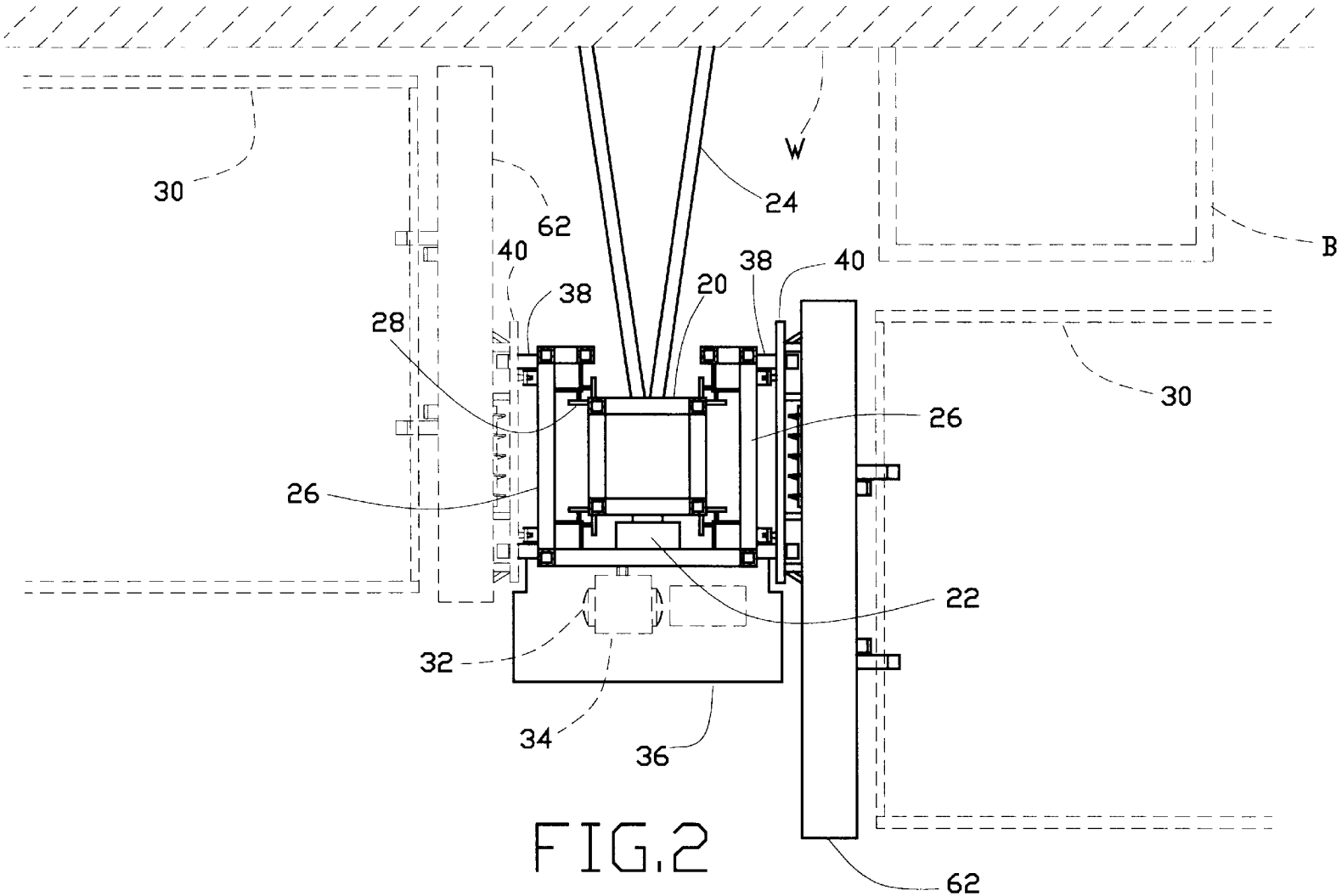
FIG. 2 is a partial plan section taken along line 2—2 of FIG. 1.
Figure 3:
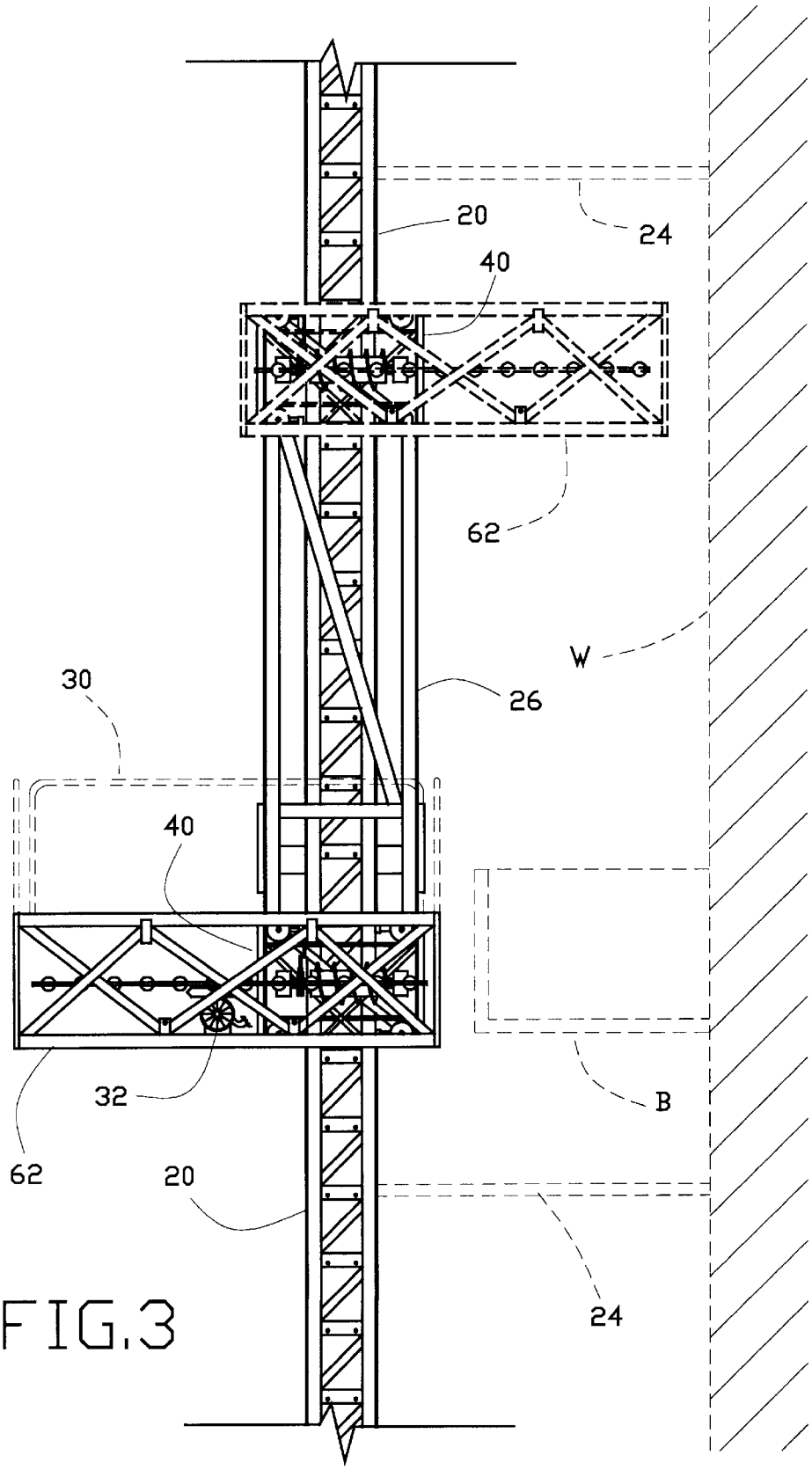
FIG. 3 is a partial elevation taken along line 3—3 of FIG. 1.
Figure 4:
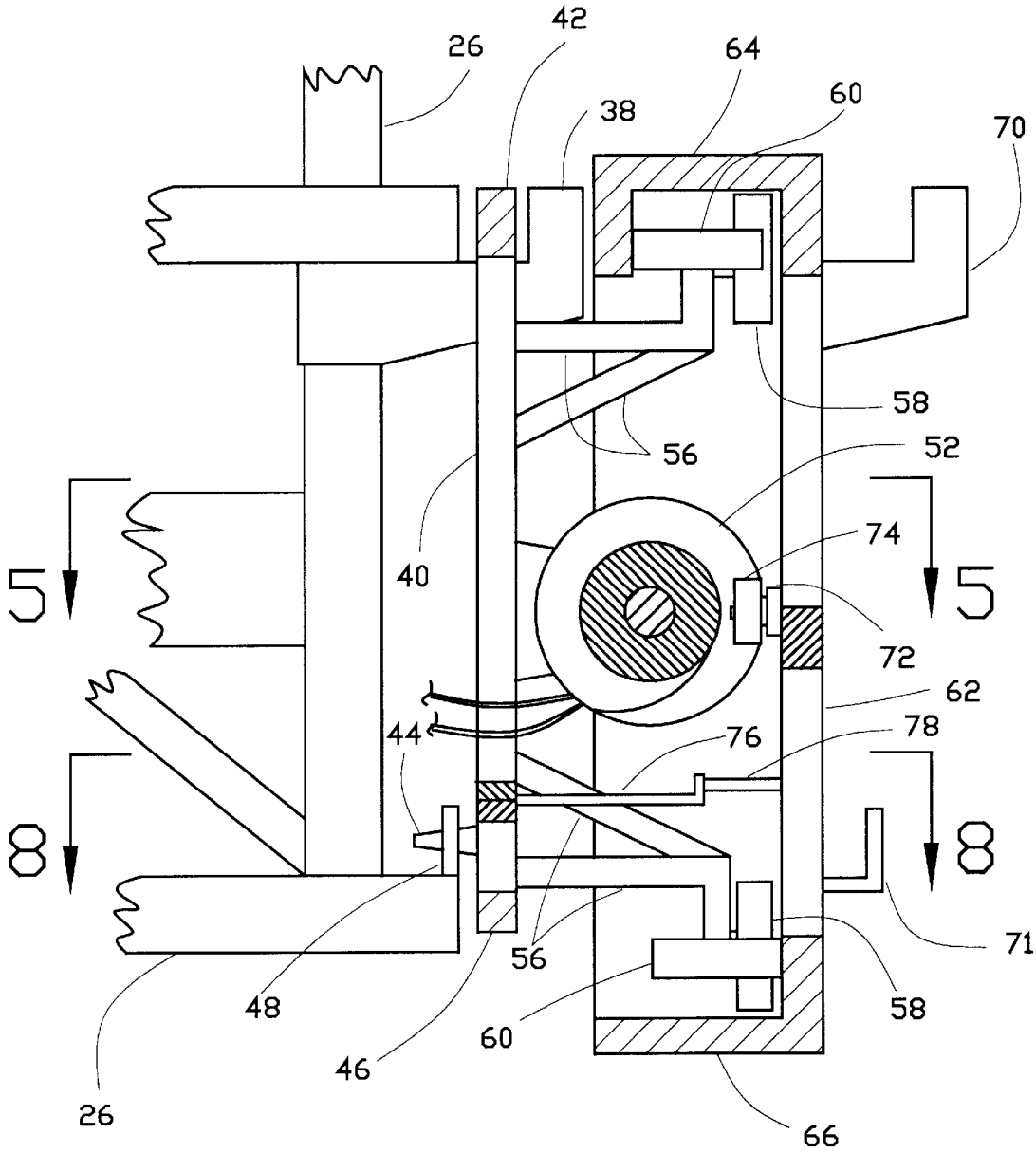
FIG. 4 is a vertical section taken in area 4 of FIG. 1.

Referring to FIGS. 1 and 2, there are shown two towers 20 supported on the ground by bases (not shown) and each attached to a building wall W by means of vertically spaced wall anchors 24. The towers 20 are of square cross-section and the two towers 20 are equally spaced from the wall W and at a certain distance from each other, for instance one hundred feet.

A sleeve member 26 partially surrounds each tower 20 and is vertically guided for up and down movement along the tower 20 by means of rollers such as 28 in FIG. 2. The wall anchors 24 are cleared by the sleeve members 26 during their up and down movement. These sleeve members are guided along the respective towers by rollers 28.

Any work platform raising system 22 can be used such as the one described in U.S. Pat. No. 5,636,705. Preferably, each sleeve 26 has a certain height so as to support two work platforms 30 in superposed position as shown in FIG. 1. These work platforms 30 are supported at each end by the respective sleeve 6.

The motorized raising system 22 includes a gasoline engine 32 driving a hydraulic pump 34 mounted on a shelf 36 secured to each sleeve 26. Obviously, an electric driving system could be provided.

A pair of hooks 38 are secured to each side of the sleeve 26 and at its top and lower ends of the same. These hooks 38 normally serve to removable support the two ends of the work platform 30 in accordance with the invention.

A support frame 40 is hooked onto hooks 38, this frame 40 is of generally rectangular shape and is supported horizontally across a tower 20 and normal to the wall W. The hooks 38 engage the upper longitudinal member 42 of the support frame 40 while pins 44 extend from the lower horizontal member 46 of the support frame 40 to engage the hole of ears 48 secured to the sleeve 26.

Figure 5:
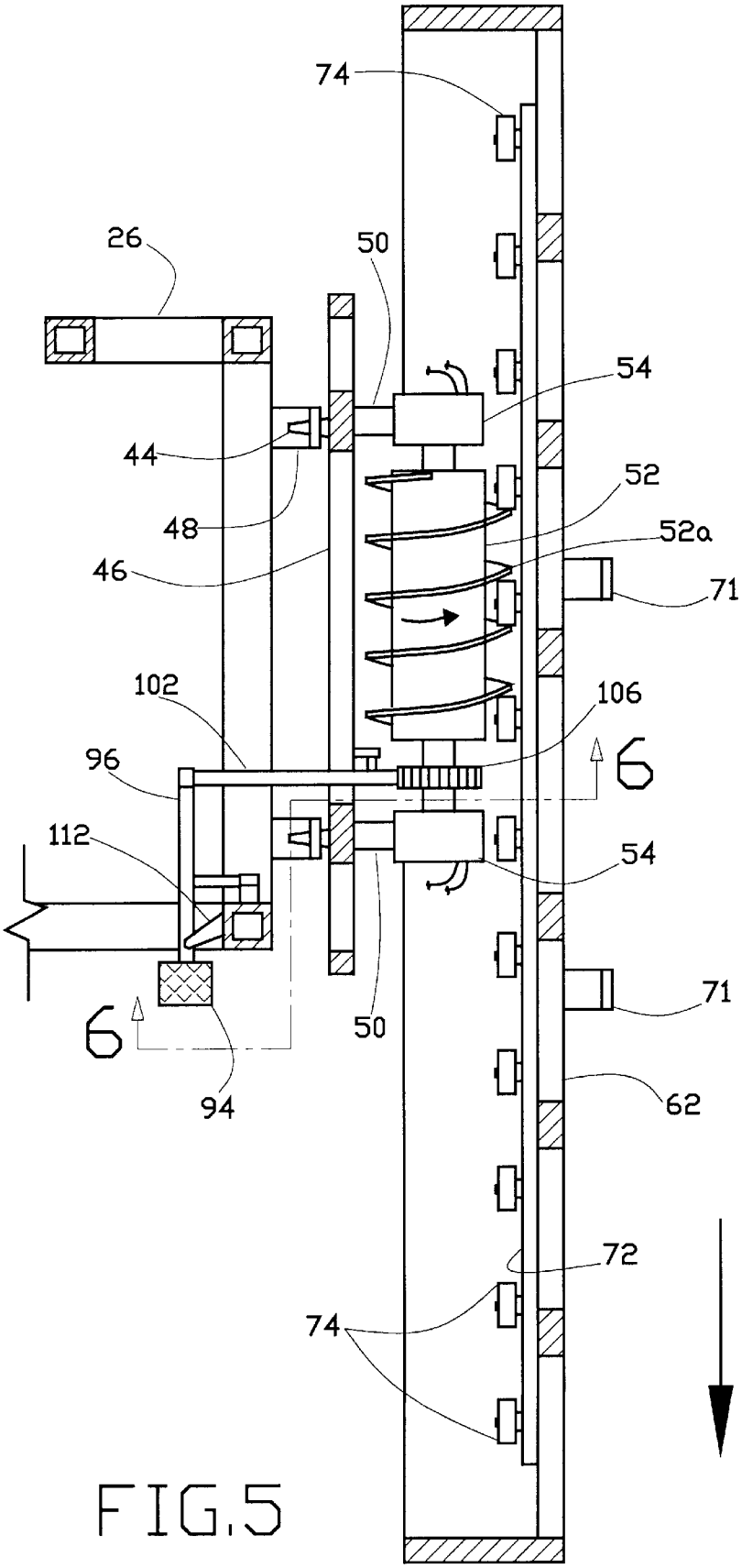
FIG. 5 is a partial plan section taken along line 5—5 of FIG. 4.

Brackets 50 are secured to the support frame 40 and rotatably support a horizontally extending endless screw 52 which is rotated two opposite directions by reversible hydraulic motors 54 carried by the brackets 50 and driving the shaft of the endless screw 52 at both ends thereof as shown in FIG. 5.

Hydraulic motors 54 are controlled by suitable valves and supplied by the hydraulic pump 34 mounted on shelf 36.

Figure 9:
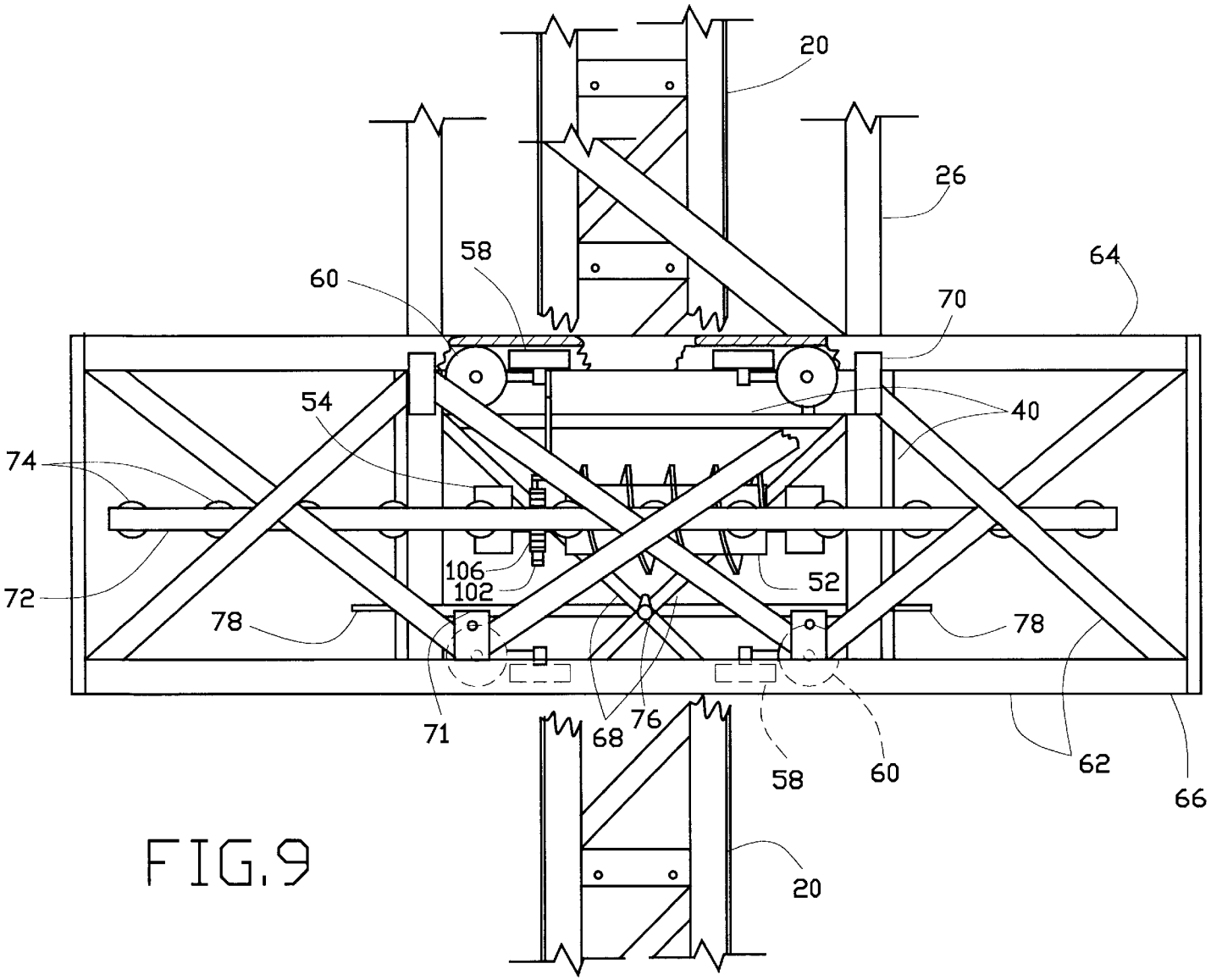
FIG. 9 is a right elevation view of the embodiment of FIG. 4.

Brackets 56 are also secured to support frame 40 and support vertical rollers 58 and horizontal rollers 60 which support and guide a shiftable frame 62 which is of generally rectangular shape and mounted for movement towards and away from wall W in a shifting movement parallel to support frame 40. The shiftable frame 62 has top and bottom longitudinal members 64 and 66 respectively which are C-Shaped and L-shaped respectively forming two flanges engaged by the vertical rollers 58 and horizontal rollers 60. Members 64 and 66 are reinforced by cross bars 68 as shown in FIG. 9.

Shiftable frame 62 is provided on its outside with platform engaging hooks 70 which are similar to the hooks 38 carried by the sleeve 26. Therefore the ends of each work platform 30 can be selectively supported either directly on the hooks 38 of sleeve 26 when no shifting movement is desired or on the hooks 70 of shiftable frame 62 with its corresponding ears 71 when platform shifting is required.

Shiftable frame 62 carries a horizontal bar 72 on which a series of equally spaced rollers 74 are mounted, these rollers at a distance equal to the pitch of the endless screw flange 52*a*. Rollers 74 are therefore arranged to effect the shifting movement of shiftable frame 62 upon rotation of the endless screw 52 in either direction.

A stop 76 is carried by the support frame 40 centrally thereof and selectively engages either one of the abutment fingers 78 carried by the shiftable frame 62 in the two limit positions of said frame 62 and consequently of the work platform 30 hooked onto the same. The shifted limit positions in both directions of the work platform 30 are preferably equally distant from the tower center.

Upon the abutment finger 78 being contacted by either one of the two stops 76, a microswitch will be operated or other system to stop movement of the endless screw 52.

Figure 6:
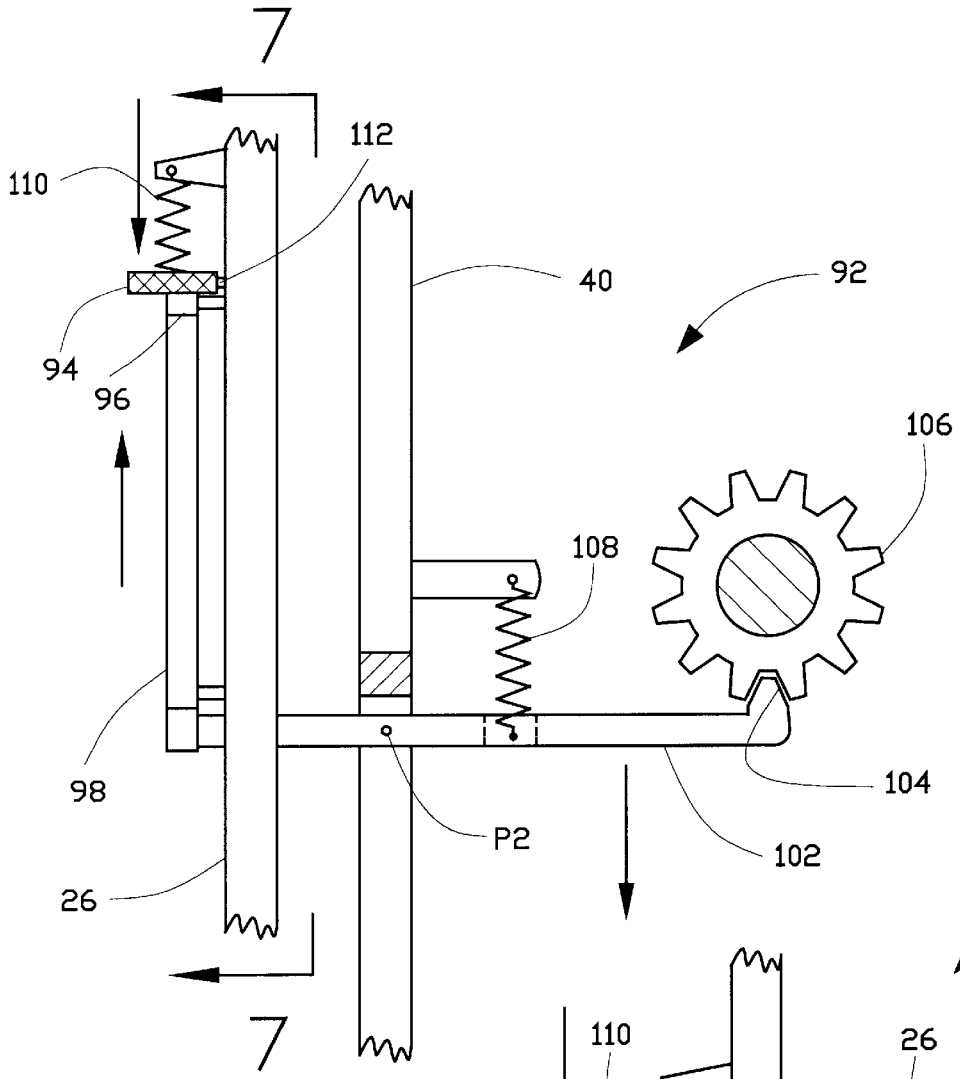
FIG. 6 is a section taken along line 6—6 of FIG. 5.
Figure 7:
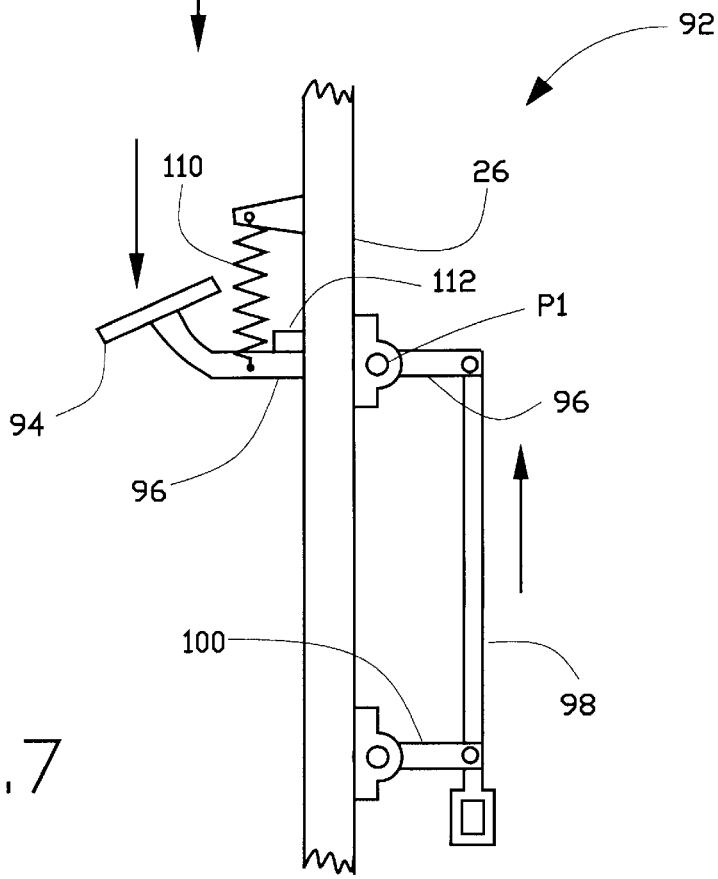
FIG. 7 is an elevation taken along line 7—7 of FIG. 6.
Figure 8:
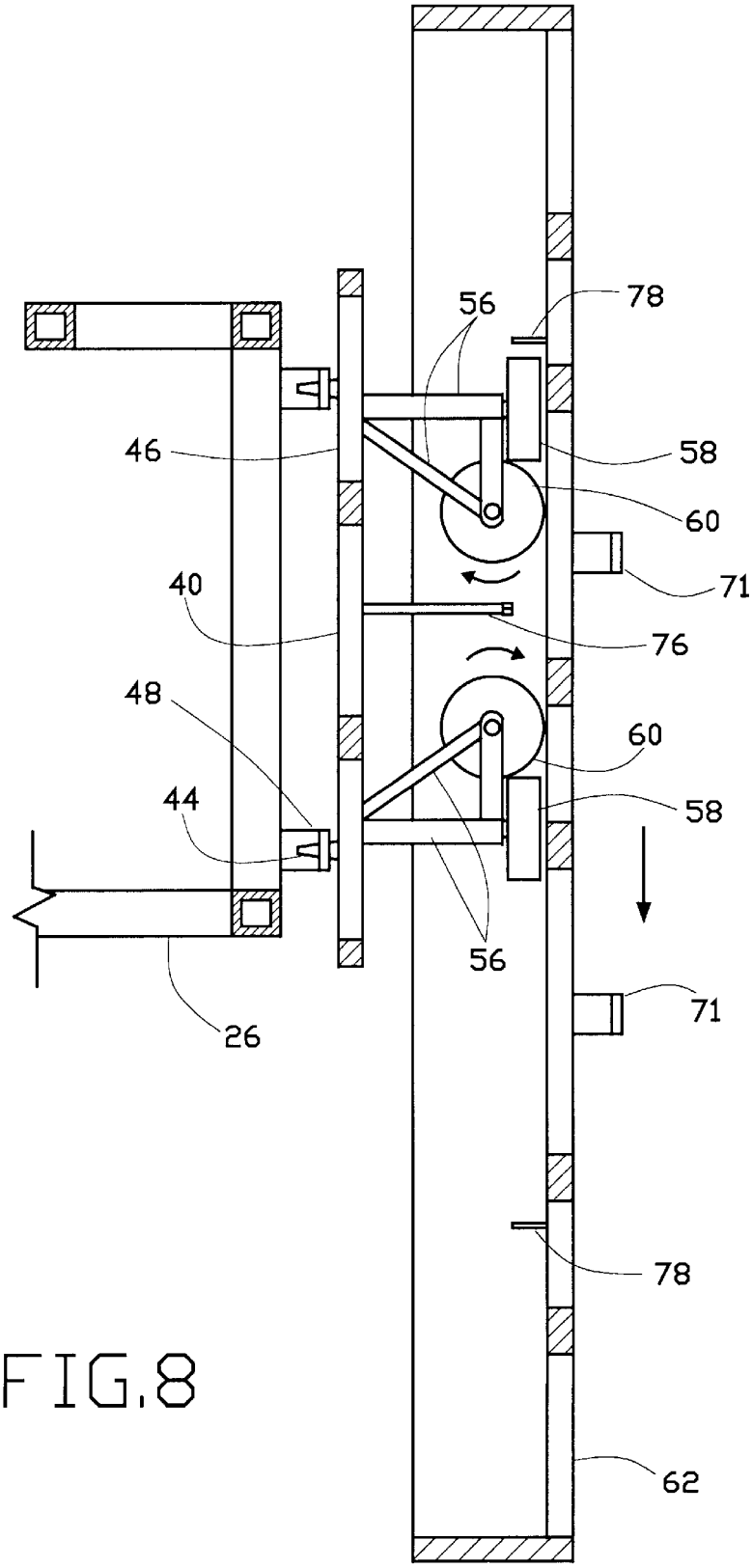
FIG. 8 is a plan section taken along line 8—8 of FIG. 4.

Preferably, a pedal operated safety system 92 (as shown in FIGS. 5, 6 and 7) is provided for the operator to allow for movement of the endless screw 52 and consequently the shifting movement of frame 62 whenever desired. Said safety system 92 needs to be operated, and held in that position, to allow movement of the endless screw 52. Said system 92 includes a pedal 94, mounted at one end of a supporting bar 96, when pushed down by an operator, make the supporting bar 96 to rotate around pivot P1 at its approximate center and mounted on the sleeve member 26 thus raising a vertical bar 98 rotatably mounted at the other end of the supporting bar 96. The vertical bar 98 is guided by a guiding bar 100 parallel to the supporting bar 96 and also rotatably mounted on the sleeve member 26. The bottom end of the vertical bar 98 is adapted to be releasably engaged by one end or a horizontal bar 102 rotatably secured at its approximate center to the support frame 40 at pivot P2. The other end of the horizontal bar 102 includes a tooth 104 that engages two adjacent teeth of a gear 106 secured to the shaft of the endless screw 52. A first spring 108 biases the horizontal bar 102 such that it is kept in the gear engaging position so as to prevent rotation of the endless screw 52. At the other end of the safety system 92, there is a second spring 110 biasing the supporting bar 96 against a stopper 112 when it is not activated by the operator. This stopper 112 ensures a proper position of the vertical bar 98 for engagement of the end of the horizontal bar 102 when the support frame 40 is being mounted on the sleeve member 26.

Figure 10:
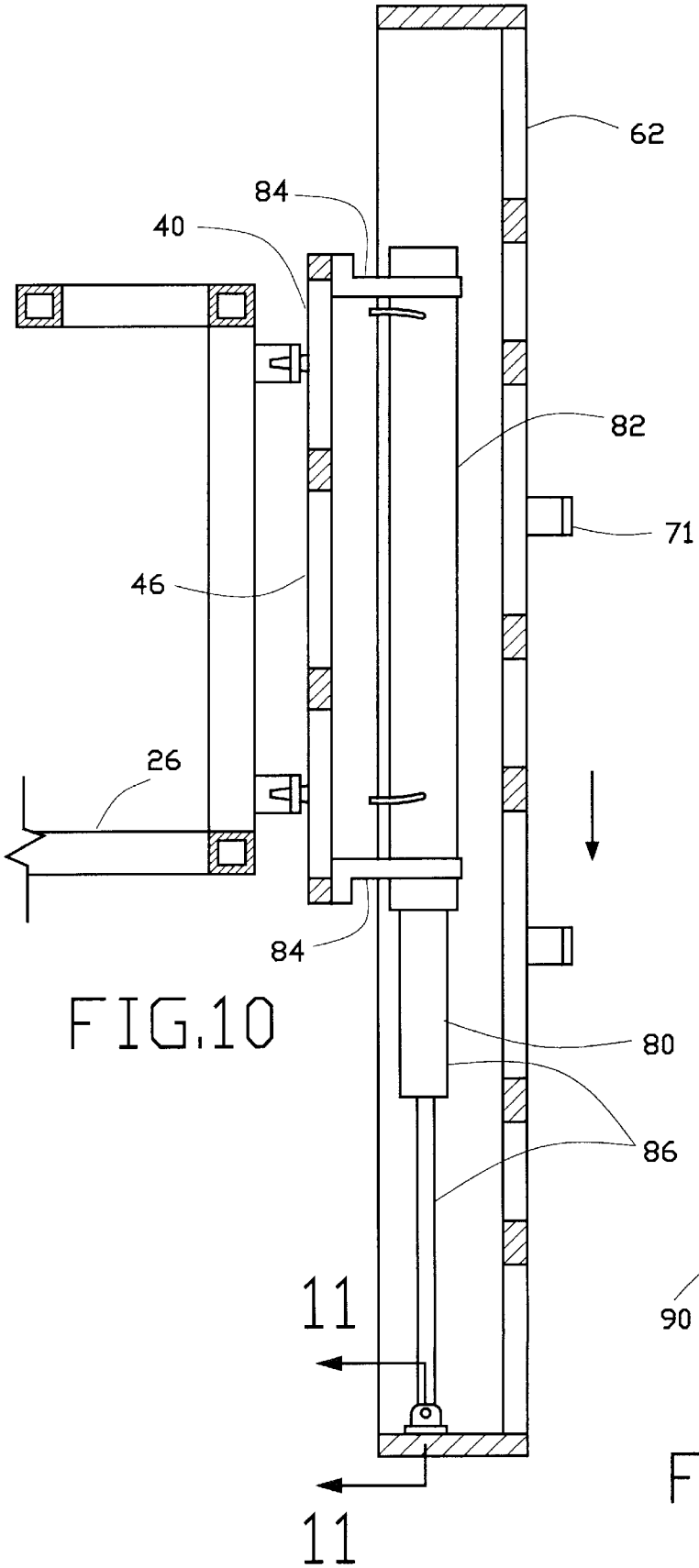
FIG. 10 is a view similar to that of FIG. 5 but showing an alternate embodiment of the actuator.
Figure 11:
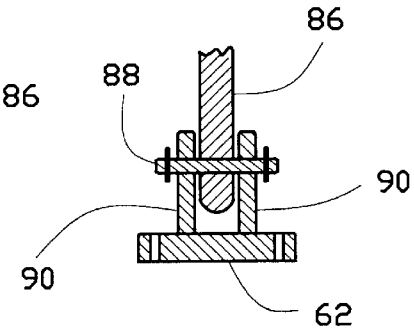
FIG. 11 is a partial section taken along line 11—11 of FIG. 10.
Figure 12:
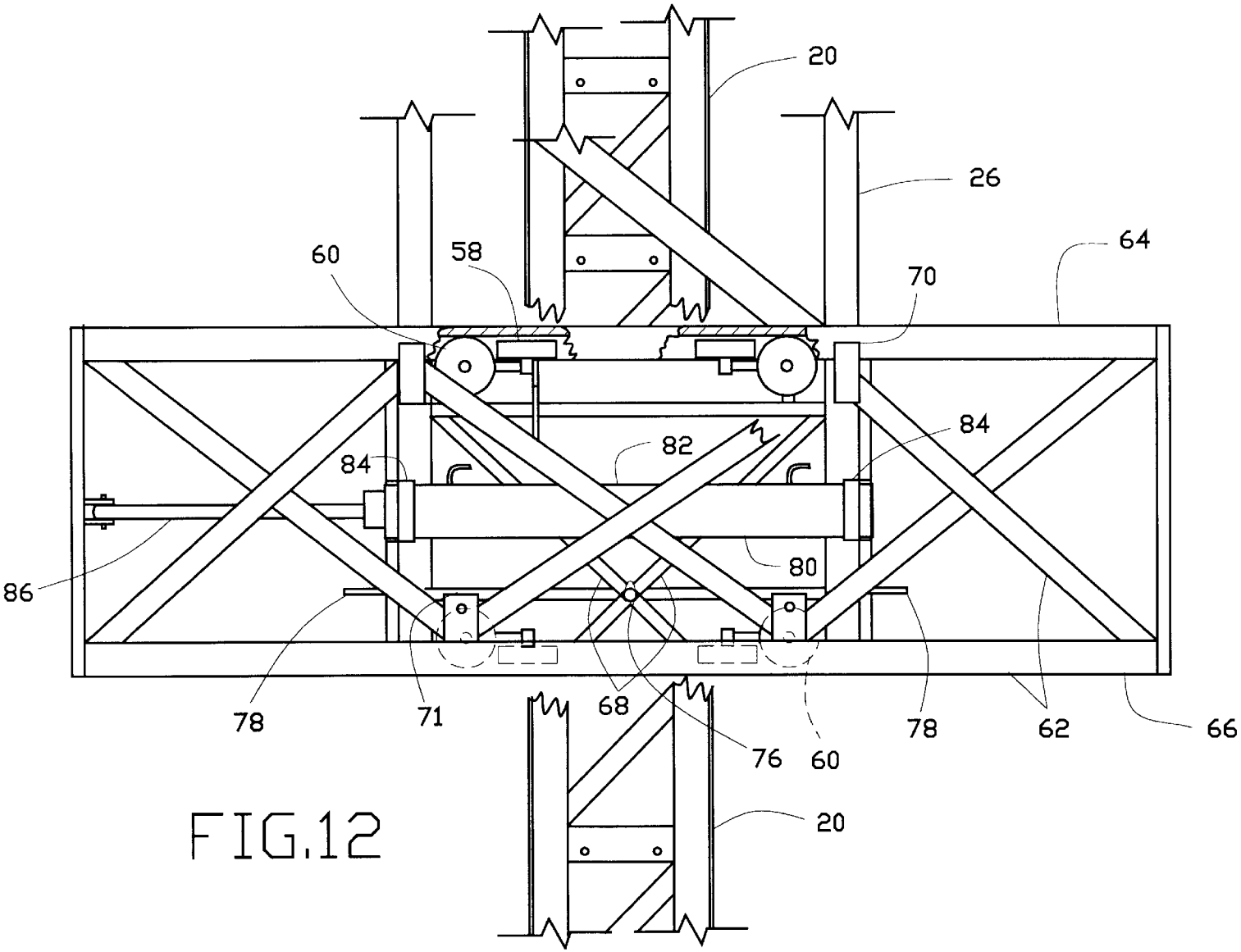
FIG. 12 is a view similar to that of FIG. 9 but showing the alternate embodiment represented in FIG. 10.

The actuator, including the endless screw 52, the hydraulic motors 54 and the driven rollers 74 can be replaced if desired by a hydraulic ram such as shown in FIGS. 10 and 11, the ram 80 is in the form of a reversible hydraulic cyclinder and piston unit, the cylinder 82 is carried by support frame 40 by means of brackets 84 while the piston rod 86 is attached by a cross pin 88 to ears 90 secured to shiftable frame 62.

Limit positions of the piston rod 86 serves to replace the arrangement of the stops 76 and abutment fingers 78 of the previous embodiment. In this embodiment, the safety system 92 is not required.

It will be noted that the work platform 30 can be shifted towards or away from the wall W and amount to three or four feet from its centered position with respect to the towers 20. It follows that when the scaffolding is installed, the towers 20 can be arranged at such a distance from the wall W that normally the work platform 30, when centered, would not clear balconies B protruding from the wall W as shown in FIG. 2. With the shifting arrangement of the invention, the work platform 30 can be laterally shifted to enable the bricklayers to be close to the wall W before and after clearing the balconies B. Clearance of these balconies B is achieved by outwardly shifting the work platform 30.

In the drawings, a work platform 30 is suspended at each end by the shifting system of the invention but obviously a work platform 30 can be supported in overhang position by only one shifting system at one end provided the platform 30 is short enough.

I claim:

1. In a scaffolding comprising a vertically extending tower, a plurality of vertically spaced anchors adapted to secure said tower to a wall, a sleeve partially surrounding said tower, driven and guided for up and down movement along the same, a support frame releasably secured to said sleeve in vertical position and normal to said tower, a shiftable frame moveably supported by and parallel to said support frame, a work platform extending generally parallel to and releasably secured to said shiftable frame at one end for horizontal shifting movement of said shiftable frame transversely of said tower, and an actuator carried by said support frame and acting on said work platform through the intermediary of said shiftable frame to effect said shifting movement.

2. In a scaffolding as defined in claim 1, further including first and second similar upwardly directed hooks respectively secured to said sleeve and to said shiftable frame, said support frame releasably supported by said first hooks and said platform releasably supported by said second hooks and capable of being directly releasably supported by said first hooks in the absence of said support frame, said actuator and said shiftable frame.

3. In a scaffolding as defined in claim 1, further including rollers carried by said support frame and rollably supporting said shifting frame.

4. In a scaffolding as defined in claim 1, wherein said actuator includes an endless screw rotatably mounted on said support frame with its rotation axis parallel to the shifting direction of said shiftable frame, reversible motors to rotate said screw in opposite directions and equally spaced endless screw engaging members secured to said shiftable frame.

5. In a scaffolding as defined in claim 1, wherein said actuator includes a double acting hydraulic ram for shifting said shiftable frame between two shifted limit positions.

6. In a scaffolding as defined in claim 2, further including rollers carried by said support frame and rollably supporting said shiftable frame.

7. In a scaffolding as defined in claim 6, wherein said actuator includes and endless screw rotatably mounted on said support frame with its rotation axis parallel to the shifting direction of said shiftable frame, reversible motors to rotate said screw in opposite directions and equally spaced endless screw engaging members secured to said shiftable frame.

8. In a scaffolding as defined in claim 6, wherein said actuator includes a double acting hydraulic ram for shifting said shiftable frame between two shifted limit positions.

9. In a scaffolding as defined in claim 5, further including an abutment secured to said support frame and stops secured to said shiftable frame and selectively engaging said abutment at two shifted limit positions of said shiftable frame.

10. In a scaffolding as defined in claim 9, wherein said two limit positions are substantially equally distant from an intermediate position wherein said shiftable frame is substantially centered relative to said support frame and to said tower.

11. In a scaffolding as defined in claim 5, wherein said two limit positions are substantially equally distant from an intermediate position wherein said shiftable frame is substantially centered relative to said support frame and to said tower.

12. In a scaffolding as defined in claim 1, further including a second tower, an additional plurality of vertically spaced anchors adapted to secure said second tower to said wall in a spaced position along said wall relative to said first tower, a second sleeve partially surrounding said second tower driven and guided for up and down movement along said second tower, a second support frame releasably secured to said second sleeve in vertical position and normal to said second tower, a second shiftable frame supported by and parallel to said second support frame, said work platform extending horizontally between and releasably secured to the respective shiftable frames at both ends, for horizontal shifting movements transversely of both towers and an actuator carried by each of said support frames and acting on the respective ends of said support platform through the intermediary of said respective shiftable frames to effect said shifting movement.

* * * * *